United States Patent [19]

Lindblad

[11] Patent Number: 4,547,060

[45] Date of Patent: Oct. 15, 1985

[54] CHARGING APPARATUS

[75] Inventor: Nero R. Lindblad, Palmyra, N.Y.

[73] Assignee: Xerox Corporation, Stamford, Conn.

[21] Appl. No.: 556,825

[22] Filed: Dec. 1, 1983

[51] Int. Cl.[4] ..... G03G 15/00

[52] U.S. Cl. ..... 355/3 R; 355/3 CH; 430/31; 430/902; 361/225

[58] Field of Search ..... 355/3 CH, 14 CH, 3 R; 430/902, 31; 361/225

[56] References Cited

U.S. PATENT DOCUMENTS

| | | | |
|---|---|---|---|
| 2,777,418 | 1/1957 | Gundlach | 118/51 |
| 3,084,043 | 4/1963 | Gundlach | 430/103 |
| 4,124,287 | 11/1978 | Bean et al. | 355/3 R |
| 4,265,990 | 5/1981 | Stolka et al. | 430/59 |
| 4,336,565 | 6/1982 | Murray et al. | 355/3 CH X |
| 4,371,252 | 2/1983 | Uchida et al. | 355/3 CH |
| 4,385,823 | 5/1983 | Kasper et al. | 355/3 R |

*Primary Examiner*—A. T. Grimley
*Assistant Examiner*—J. Pendegrass

[57] ABSTRACT

Apparatus for forming images on a charge-retentive surface including uncharged toner particles which are applied to electrostatic latent images formed on the surface. The latent image is formed on the charge-retentive surface by exposing a charged surface to a light pattern of an image to be reproduced. Prior to image exposure, the charge pattern comprises a periodic line screen pattern which is formed by means of a conductive charging brush having a suitable bias voltage applied thereto at a frequency suitable for forming the line screen pattern. By using such an arrangement charging and screening of the charge-retentive surface occur simultaneously.

4 Claims, 2 Drawing Figures

CHARGING APPARATUS

Figure 1:
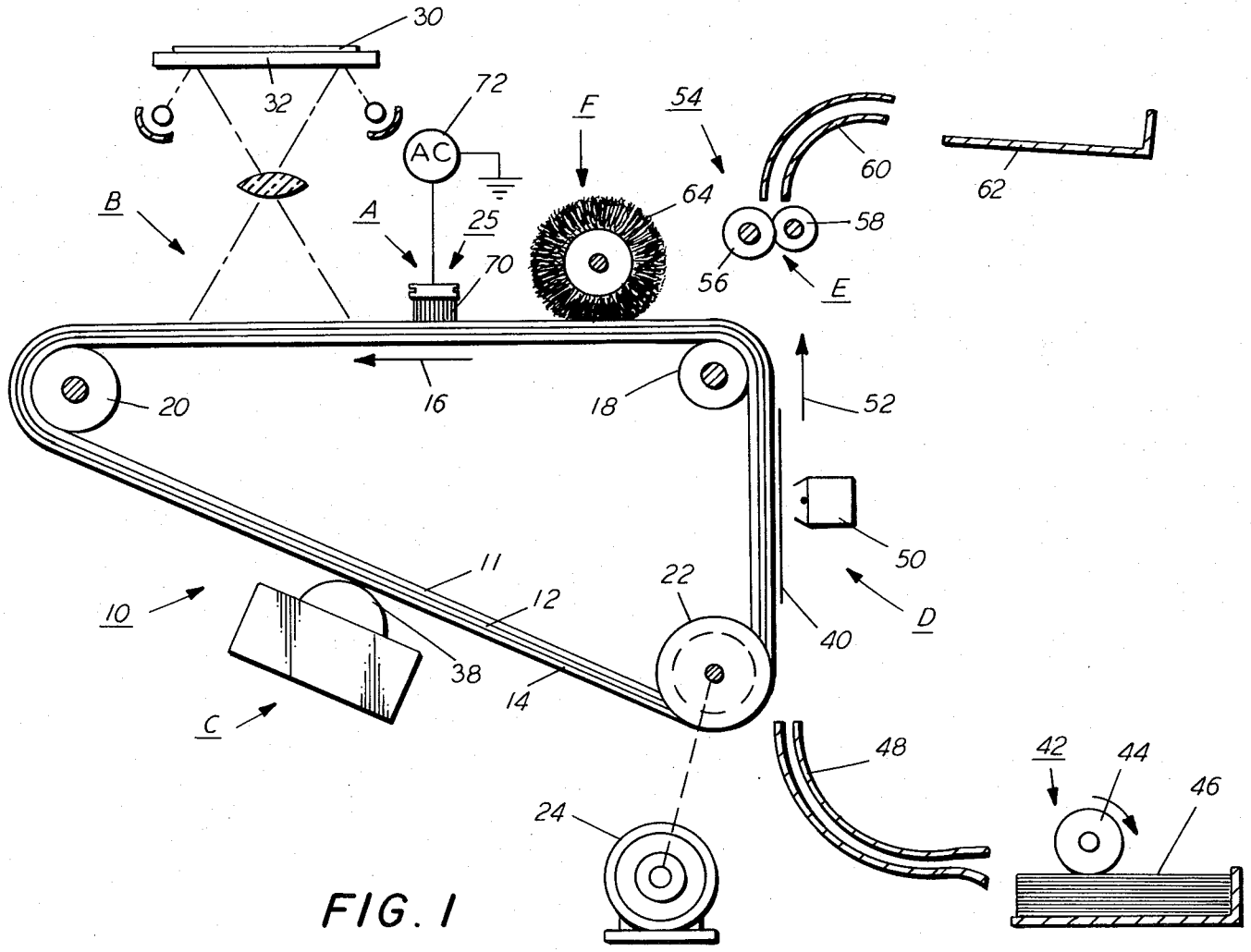

The present invention relates generally to the formation and development of charge patterns on a charge-retentive surface and more particularly to the formation of imagewise, non-uniform charge patterns and the development thereof with finely divided, uncharged, marking material commonly referred to as toner.

In printing arts of the type contemplated, a charge-retentive surface such as a photoconductor which comprises a photoconductive insulating material adhered to a conductive backing is charged uniformly. Then the photoconductor is exposed to a light image of an original document to be reproduced. The latent electrostatic images, thus formed, are rendered visible by applying any one of numerous pigmented resins specifically designed for this purpose. In the case of a reusable photoreceptor, the pigmented resin, more commonly referred to as toner which forms the visible images is transferred to plain paper. After transfer, toner images are made to adhere to the copy medium usually through the application of heat and pressure by means of a roll fuser.

The aforementioned pigmented resin comprises a finely divided, colored toner which carries a charge of the opposite polarity to that of the imagewise, non-uniform charge patterns formed as discussed above. Because opposite polarities attract, the toner particles adhere to the charge-retentive surface in accordance with charge patterns remaining.

The toner particles are most usually charged to the opposite polarity prior to development by rubbing contact with a carrier material. The carrier material is one which is removed from the toner material in the triboelectric series. The carrier material is usually in the form of particles of a larger size than the toner particles, although the carrier may, in some cases, be a liquid.

The toner is usually applied to the surface by cascading or flowing the toner or a toner-carrier combination (generally referred to as developer) across the surface. Other well known toner application methods include magnetic brush development, electrophoretic development and out-of-contact liquid development, such as that described in U.S. Pat. No. 3,084,043 to Gundlach.

The toner-carrier combination which is well known in conventional xerography is somewhat dependent on the ambient relative humidity for successful operation. The humidity is preferably lower. Proper triboelectric charging of the toner is difficult if the humidity is too high.

Another difficulty of the toner-carrier combination is that the carrier can become coated with a thin layer of toner material after long periods of use. This is generally referred to as carrier aging. Such coated carrier material cannot be used efficiently to triboelectrically charge the toner material.

An imaging process which enables the use of a toner material which does not have to be charged to one polarity or another before development is obviously desirable. A toner material which is readily useful without a carrier would also be desirable.

In conventional xerography, the toner particles adhere to the charge-retentive surface at the point of charge differential. For example, a plate is charged to about 1,000 volts and then imagewise exposed. Exposure reduces the charge in the light struck areas to about 200 volts, leaving about 800 volts in non-light struck areas. The line between a 200 volt area and an 800 volt area on a surface attracts toner particles. However, solid area coverage of a large area of uniform 800 volt charge cannot normally be accomplished without the aid of such sophisticated and complex mechanisms as magnetic developers or development electrode systems. U.S. Pat. No. 2,777,418 to Gundlach shows a typical development electrode used to achieve said area coverage of a large uniform charge pattern using charged toner. A development system which would make available solid area coverage without such complex mechanisms and with uncharged toner is desirable.

Even when magnetic brush development or a developer electrode are used to achieve solid area development, the problem of "developer starvation" is observed. This undesirable phenomenon manifests itself as a reduction of density as large solid areas are developed.

The foregoing problems have been satisfactorily overcome by the use of a screen which forms a uniform pattern of dark and light on a uniformly charged photoconductor when the photoconductor is exposed to light through the screen. Such an arrangement is disclosed in U.S. Pat. No. 4,124,287 issued to Bean et al. As disclosed therein, means are provided for forming an imagewise non-uniform charge pattern including means (i.e. corona device 90) for uniformly charging a charge-retentive surface, means (i.e. transparent tube 92 having a screen pattern marked on its surface and a fluorescent tube 93) for exposing the surface, subsequent to uniform charging, to a regular pattern of dark and light and means at imaging station 95 for subsequently exposing the surface to an imagewise pattern of light.

By exposing the uniformly charged surface to a regular pattern of dark and light with either simultaneous or subsequent exposure to a non-regular light pattern, a fringe field pattern is established adjacent the charged surface. As described in the aforementioned patent such a pattern is useful in the imaging process where uncharged toner particles are employed.

In practice, it has been discovered that it is necessary to position the screen of the type described in U.S. Pat. No. 4,124,287 very close to the photoreceptor in a position that makes it susceptible to contamination by toner. When the open areas of the screen become obstructed the effectiveness of the screen is deminished.

In order to provide an improved printing machine which obviates certain shortcomings of prior art machines, the present invention comprises a combination charging and screening device which is used for charging a charge-retentive surface while at the same time creating a screen pattern on the surface. The screen pattern is created without the use of a screen of the type used in the prior art, for example, as that shown in U.S. Pat. No. 4,124,287. Thus, the problem of a screening device becoming ineffective because of toner or some other contaminants blocking the open area thereof is eliminated. To this end, there is provided a conductive brush which is used for the charging of the charge-retentive surface. The brush has applied thereto an a.c. voltage which when applied at the proper frequency produces a periodic line screen pattern suitable for use with uncharged toner.

Other aspects of the present invention will become apparent as the following description proceeds with reference to the drawings.

Figure 2:
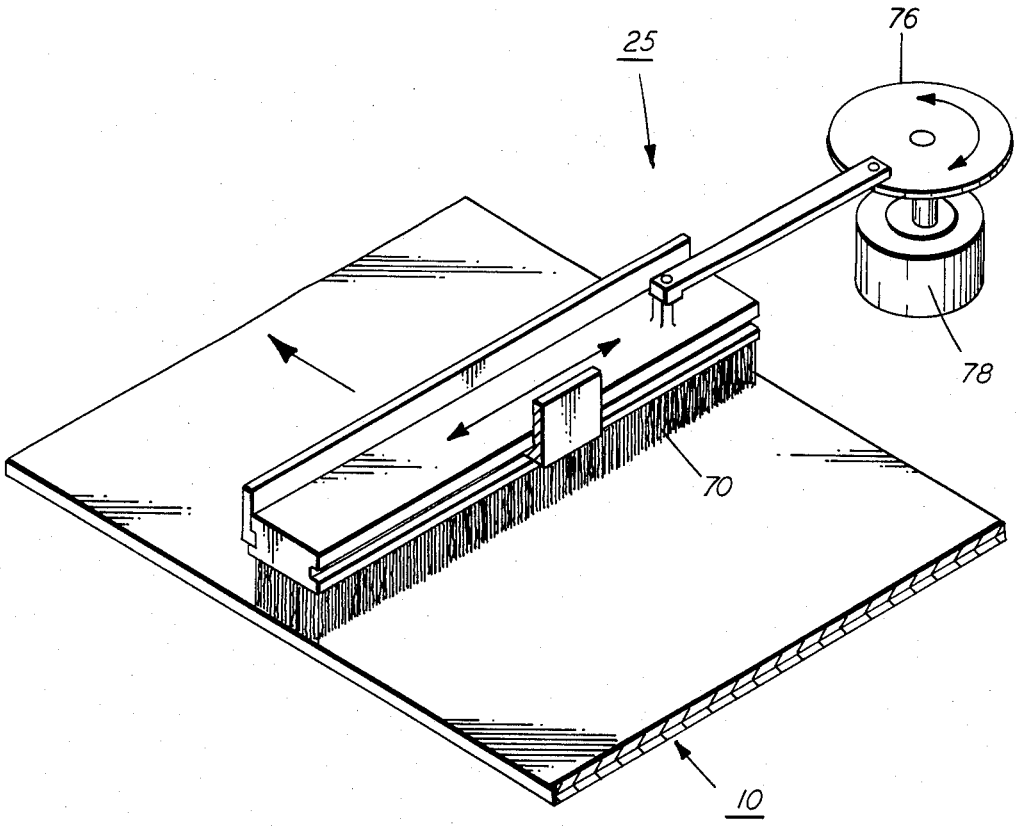

FIG. 1 is a schematic elevational view depicting an electro-photographic printing machine incorporating the present invention; and FIG. 2 is a fragmentary perspective view illustrating an embodiment of a conductive charging brush utilized in the printing machine illustrated in FIG. 1.

Inasmuch as the art of electrophotographic printing is well known, the various processing stations employed in the printing machine illustrated in FIG. 1 will be described only briefly.

As shown in FIG. 1, the printing machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoreceptor of this type is disclosed in U.S. Pat. No. 4,265,990 issued May 5, 1981 in the name of Milan Stolka et al. The disclosure of which is incorporated herein by reference. Belt 10 moves in the direction of arrow 16 to advance successive portions thereof sequentially through the various processing stations disposed about the path of movement thereof.

Belt 10 is entrained about stripping roller 18, tension roller 20 and drive roller 22. Roller 22 is coupled to motor 24 by suitable means such as a drive chain.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a conductive brush, indicated generally by the reference numeral 25, charges layer 12 of belt 10 to a relatively high, substantially uniform negative potential.

Next, the charged portion of the photoreceptor belt is advanced through exposure station B. At exposure station B, an original document 30 is positioned face down upon a transparent platen 32. The light rays reflected from original document 30 from images which are transmitted through lens 36 the light images are projected onto the charged portion of the photoreceptor belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 advances a magnetic, uncharged developer into contact with the electrostatic latent image. The fringe field pattern formed by the charging brush and subsequent exposure attracts the developer particles from the roller thereby forming powder images on the photoreceptor belt.

Belt 10 then advances the powder image to transfer station D. At transfer station D, a sheet of support material 40 is moved into contact with the toner powder images. The sheet of support material is advanced to transfer station D by a sheet feeding apparatus 42. preferably, sheet feeding apparatus 42 includes a feed roll 44 contacting the upper sheet of stack 46. Feed roll 44 rotates so as to advance the upper most sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays ions of a suitable polarity onto the backside of sheet 40 so that the toner powder images are attracted from photoconductive belt 10 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder images to sheet 40. Preferably, fuser assembly 54 includes a heated fuser roller 56 adapted to be pressure engaged with a back-up roller 58 with the toner powder images contacting fuser roller 56. In this manner, the toner powder image is permanently affixed to sheet 40. After fusing, chute 60 guides the advancing sheet 40 to catch tray 62 for removal from the printing machine by the operator. A magnetic cleaning brush 64 is supported at a cleaning station F for removing residual toner from the photoreceptor.

As illustrated in FIG. 2, the electrically conductive brush 25 comprises conductive fibers 70 of steel, carbon coated nylon, carbon coated rayon or graphite. The density of the fibers which have a diameter in the order of 10–60 microns and a resistance of $10^5$ ohm/cm is in the order of 15–60K/in$^2$.

When an a.c. voltage source 72 is applied to the brush at a suitable frequency a periodic line screen pattern is produced. The actual frequency depends on the operating speed of the process. For example, when the process speed was measured at 12.7 cm/sec and the frequency was 400 Hz a.c. with an a.c. voltage of 1500 and a d.c. bias of 900 volts, the measured frequency of the line pattern was 40 lines/cm, the brush which had a width of 1 cm was in contact with the charge-retentive surface for 0.078 sec. With this screen pattern, uniform solid area development was achieved with minor streaking in the solid area. The minor streaking is eliminated by vibrating the brush at 400 rpm means of a cam 76 driven via a motor 78.

I claim:

1. The method of forming toner images on a charge-retentive surface moving in a first direction, said method including the steps of:

contacting said charge-retentive surface with an electrically conductive brush;

electrically biasing said brush to a voltage at a frequency suitable for forming a line screen pattern on said charge-retentive surface capable of attracting non-charged toner;

simultaneously vibrating said brush in a second direction substantially perpendicular to said first direction;

exposing said pattern to a light image to thereby selectively discharge said pattern; and presenting uncharged toner to the discharged pattern.

2. Apparatus for forming images on a charge retentive surface, said apparatus comprising:

means for moving said charge-retentive surface in a first direction;

an electrically conductive brush supported for contact with said charge-retentive surface;

means for electrically biasing said conductive brush to a voltage which is applied at a frequency suitable for forming a periodic line pattern on said charge-retentive surface;

means for vibrating said brush in a second direction which is substantially perpendicular to said first direction;

means for exposing said line pattern to an image to be reproduced to thereby form a latent electrostatic image on said surface and means for applying uncharged toner to said surface.

3. Apparatus according to claim 2 wherein an a.c. voltage of approximately −1200 volts with a bias of −900 volts d.c. at a frequency of approximately 400 Hz is applied to said conductive brush.

4. Apparatus according to claim 3 wherein said charge-retentive surface comprises a photoconductor.

* * * * *